US007331768B2

(12) United States Patent
Wu

(10) Patent No.: US 7,331,768 B2
(45) Date of Patent: Feb. 19, 2008

(54) PUMP WITH GAUGE

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 531 days.

(21) Appl. No.: 10/775,499

(22) Filed: Feb. 9, 2004

(65) Prior Publication Data

US 2004/0156726 A1 Aug. 12, 2004

Related U.S. Application Data

(63) Continuation-in-part of application No. 10/189,441, filed on Jul. 8, 2002, now Pat. No. 6,739,842.

(51) Int. Cl.
*F04B 19/02* (2006.01)

(52) U.S. Cl. ..... 417/63; 417/469; 417/468

(58) Field of Classification Search ..... 417/469, 417/468, 63, 527, 528
See application file for complete search history.

(56) References Cited

U.S. PATENT DOCUMENTS

| | | | | |
|---|---|---|---|---|
| 1,390,559 | A | 9/1921 | Huntley | 92/146 |
| 1,776,147 | A | 9/1930 | Clagett | 92/196.1 |
| D323,876 | S | 2/1992 | Furusawa | D23/231 |
| 5,964,577 | A | 10/1999 | Chuang | 417/63 |
| 6,196,807 | B1 | 3/2001 | Wu | 417/63 |
| 6,318,969 | B1 * | 11/2001 | Wang | 417/63 |
| 6,325,601 | B2 | 12/2001 | Wu | 417/469 |
| 6,428,290 | B1 * | 8/2002 | Wang | 417/468 |
| 6,485,264 | B1 * | 11/2002 | Wu | 417/63 |
| 6,652,242 | B2 * | 11/2003 | Wu | 417/63 |
| 6,676,390 | B2 * | 1/2004 | Wang | 417/528 |
| 6,695,595 | B2 * | 2/2004 | Wu | 417/468 |
| 6,739,842 | B2 | 5/2004 | Wu | 417/63 |
| 6,814,552 | B2 * | 11/2004 | Wu | 417/440 |

* cited by examiner

*Primary Examiner*—Anthony D. Stashick
*Assistant Examiner*—Peter J Bertheaud
(74) *Attorney, Agent, or Firm*—Alan Kamrath; Kamrath & Associates PA

(57) ABSTRACT

A pump includes a base, a pumping set, a first joint, a gauge set, a second joint and a nozzle. The base includes a socket. The gauge set includes a gauge, a housing for receiving the gauge and a tube extending from the housing. The pumping set includes a cylinder inserted in the socket and a piston put in the cylinder. The first joint is put in the cylinder and includes a transverse channel and an axial channel communicated with the transverse channel. The second joint is inserted in the socket, the cylinder, the transverse channel of the first joint and the tube. The second joint includes an axial channel, a first transverse channel for communicating the axial channel hereof with the axial channel of the first joint and a second transverse channel for communicating the axial channel thereof with the tube. The nozzle is communicated with the second joint.

15 Claims, 4 Drawing Sheets

PUMP WITH GAUGE

CROSS-REFERENCE

The present application is a continuation-in-part application of U.S. patent application Ser. No. 10/189,441 filed Jul. 8, 2002, now U.S. Pat. No. 6,739,842.

FIELD OF INVENTION

The present invention relates to a pump equipped with a gauge.

BACKGROUND OF INVENTION

Taiwanese Patent Publication No. 446070 teaches an upright pump including internal and external cylinders. This conventional pump includes a base, an internal cylinder mounted on the base, a piston movably inserted in the internal cylinder, a rod connected with the piston, an external cylinder mounted on the internal cylinder, a gauge set mounted on the external cylinder and a nozzle in communication with the gauge set through a pipe. The internal cylinder defines a space and an aperture at a lower end in communication with the space. A space is confined between the internal cylinder and the external cylinder. The space is in communication with the space through the aperture. The external cylinder defines an aperture near an upper end. The gauge set is located at the upper end of the external cylinder. A space defined in the gauge set is in communication with the space through the aperture. In pumping, pressurized air flows from the space to the space from which the pressurized air flows to the space defined in the gauge set through the aperture. This conventional pump is complicated in structure and causes trouble for a worker to assemble and therefore entails a high cost for fabrication. The pressurized air travels for a distance twice as much as the length of the internal cylinder, thus reducing efficiency for pumping.

The present invention is therefore intended to obviate or at least alleviate the problems encountered in the prior art.

SUMMARY OF INVENTION

It is the primary objective of the present invention to provide a simple pump equipped with a gauge that can easily be observed.

According to the present invention, a pump includes a base, a pumping set, a first joint, a gauge set, a second joint and a nozzle. The base includes a socket. The gauge set includes a gauge, a housing for receiving the gauge and a tube extending from the housing. The pumping set includes a cylinder inserted in the socket and a piston put in the cylinder. The first joint is put in the cylinder and includes a transverse channel and an axial channel communicated with the transverse channel. The second joint is inserted in the socket, the cylinder, the transverse channel of the first joint and the tube. The second joint includes an axial channel, a first transverse channel for communicating the axial channel hereof with the axial channel of the first joint and a second transverse channel for communicating the axial channel thereof with the tube. The nozzle is communicated with the second joint.

Other objectives, advantages and novel features of the invention will become more apparent from the detailed description when taken in conjunction with the drawings.

BRIEF DESCRIPTION OF DRAWINGS

The present invention will be described through detailed illustration of embodiments referring to the drawings.

DETAILED DESCRIPTION OF EMBODIMENTS

Figure 1:
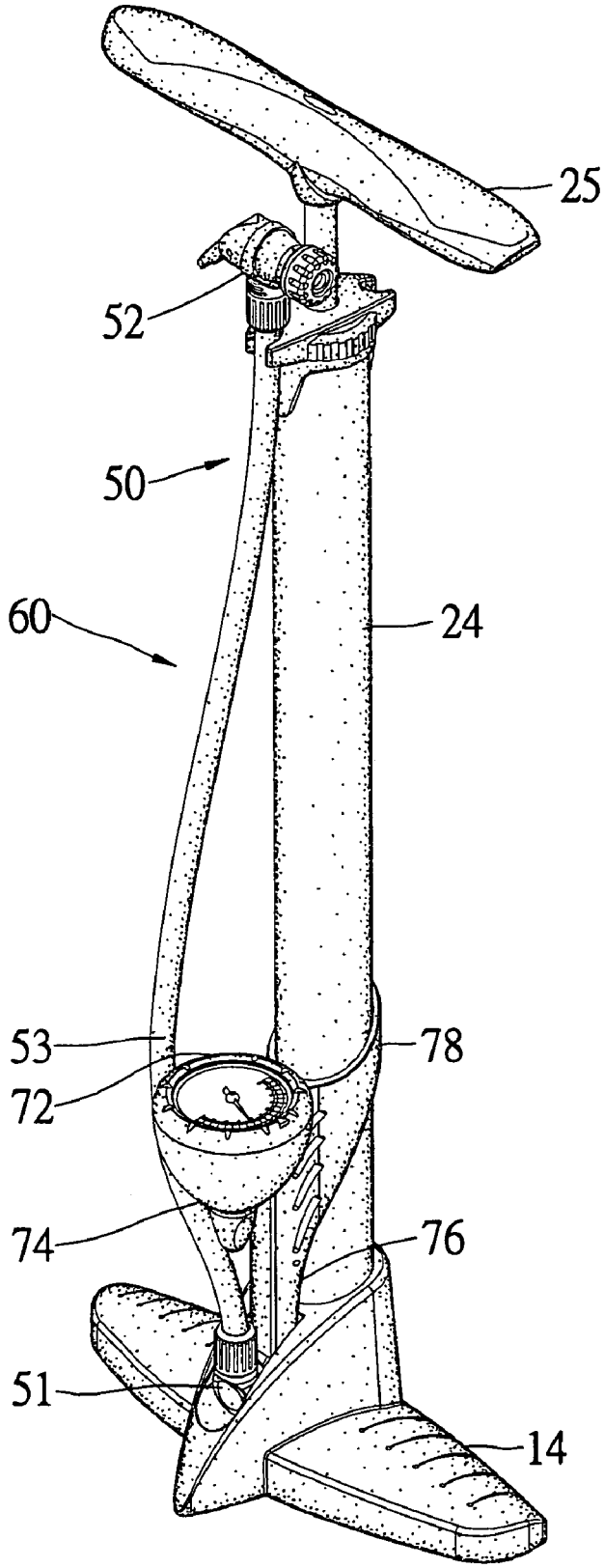
FIG. 1 is a perspective view of a pump according to a first embodiment of the present invention.
Figure 2:
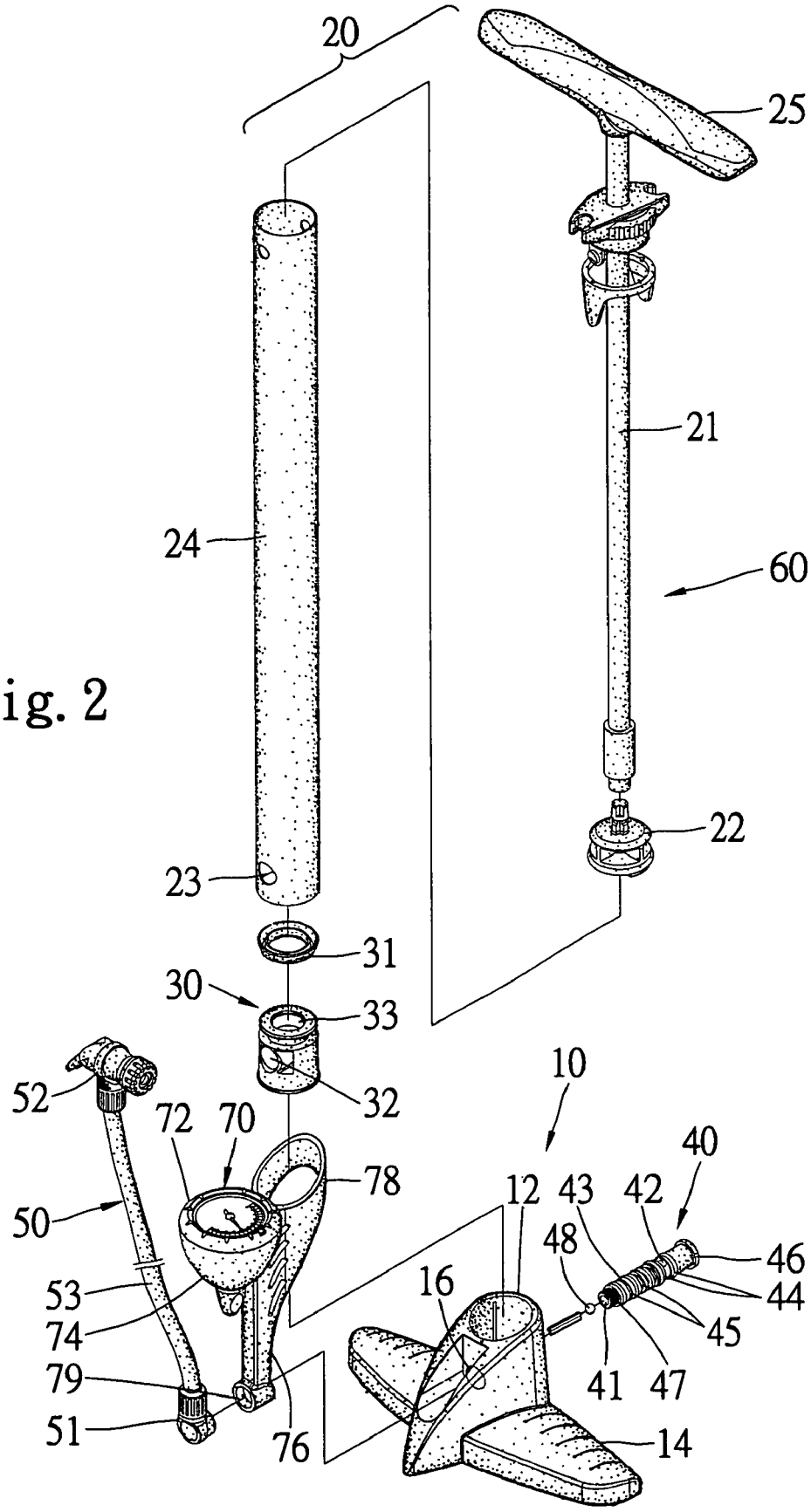
FIG. 2 is an exploded view of the pump of FIG. 1.
Figure 3:
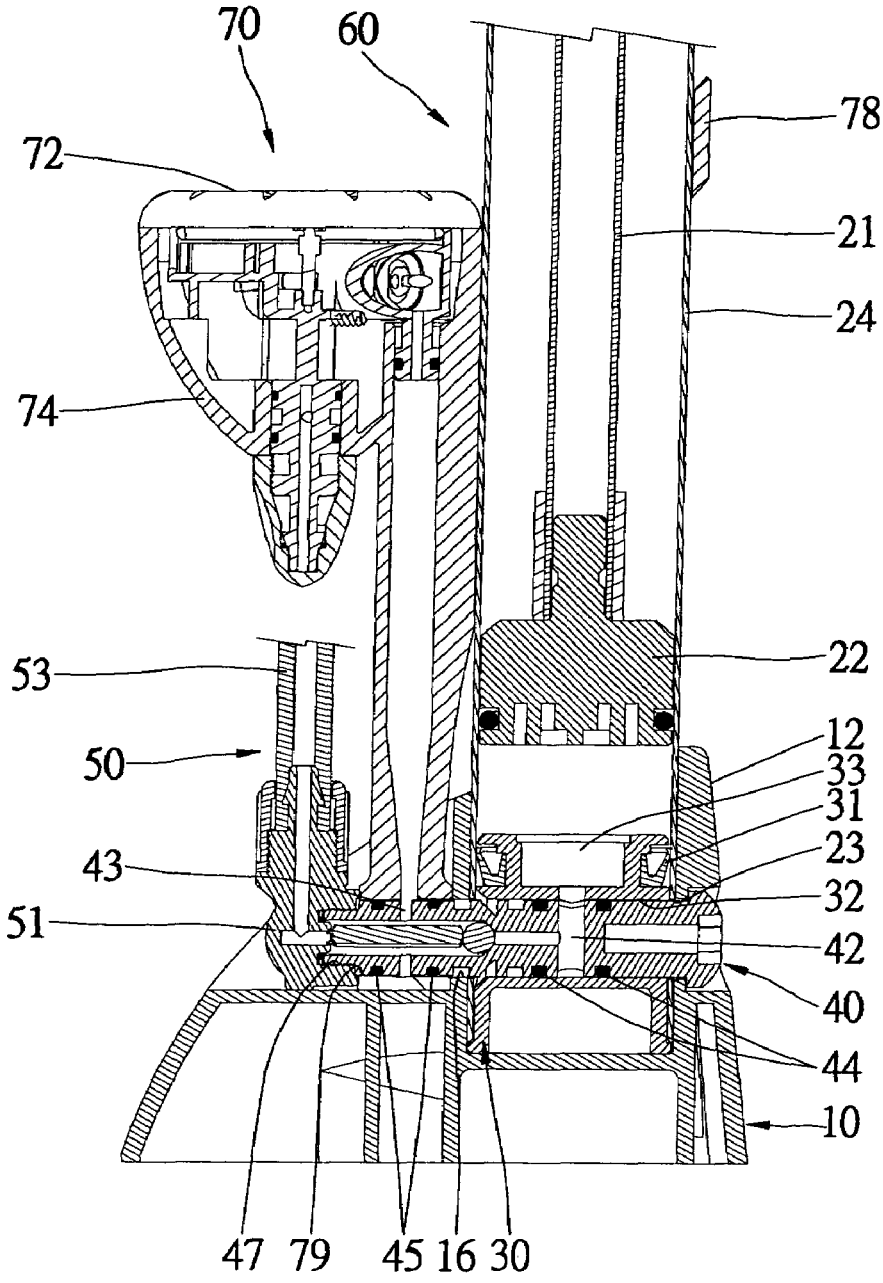
FIG. 3 is a cross-sectional view of the pump of FIG. 1.

Referring to FIGS. 1-3, a pump 60 according to a first embodiment of the present invention includes a base 10, a pumping set 20 in communication with the base 10, a gauge set 70 in communication with the base 10 and a nozzle set 50 in communication with the gauge set 70.

The base 10 includes a socket 12 and two pedals 14 extending from the socket 12. The socket 12 defines two apertures 16.

The pumping set 20 includes a cylinder 24, a piston 22 put in the cylinder 24, a rod 21 connected with the piston 22 and a handle 25 attached to the rod 21. The cylinder 24 defines two apertures 23 near a lower end thereof. The cylinder 24, the piston 22 and the rod 21 will not be described in detail for being conventional.

A first joint 30 defines a transverse channel 32 and an axial channel 33 in communication with the transverse channel 32. An annular seal 31 is mounted on the first joint 30.

The gauge set 70 includes a gauge 72, a housing 74 for receiving the gauge 72, a tube 76 extending from the housing 74 and a collar 78 formed on the tube 76. The tube 76 defines two apertures 79.

A second joint 40 includes an axial channel 41 defined therein, a first transverse channel 42 in communication with the axial channel 41 and a second transverse channel 43 in communication with the axial channel 41. A check valve 48 is installed in the axial channel 41 in order to allow air to flow from the first transverse channel 42 to the second transverse channel 43 only, not vice versa. Two annular seals 44 are mounted on the second joint 40. The first transverse channel 42 is positioned between the annular seals 44. Two annular seals 45 are mounted on the second joint 40. The second transverse channel 43 is positioned between the annular seals 45. The second joint 40 includes a head 46 at one end and a thread 47 at an opposite end.

The nozzle set 50 includes a cap 51, a nozzle 52 and a pipe 53 via which the cap 51 is communication with the nozzle 52.

In assembly, the first joint 30 is put in the lower end of the cylinder 24 so that the transverse channel 32 is in communication with the apertures 23. The annular seal 31 provides sealing between the first joint 30 and the cylinder 24. The collar 78 is put on the socket 12 so that the apertures 79 are in communication with the apertures 16. Through the collar 78, the lower end of the cylinder 24 is inserted in the socket 12 so that the apertures 23 are in communication with the apertures 16. Thus, the transverse channel 32, the apertures 23, 16 and 79 are in communication with one another.

The second joint 40 is inserted in the apertures 16 and 23 and the transverse channel 32 and the apertures 79. The axial channel 33 of the first joint 30 is in communication with the first transverse channel 42 of the second joint 40. The annular seals 44 ensure that air flows from the axial channel 33 of the first joint 30 to the first transverse channel 42 of the second joint 40. The second transverse channel 43 of the second joint 40 is in communication with the tube 76. The annular seals 45 ensure that air flows from the second transverse channel 43 of the second joint 40 to the tube 76. The air flows to the gauge 72 through the tube 76 and the housing 74.

The thread of the cap 51 is engaged with the thread 47 of the second joint 40. The axial channel 41 is communication with the cap 51. The nozzle 52 can be engaged with a valve of an article to be pumped.

Figure 4:
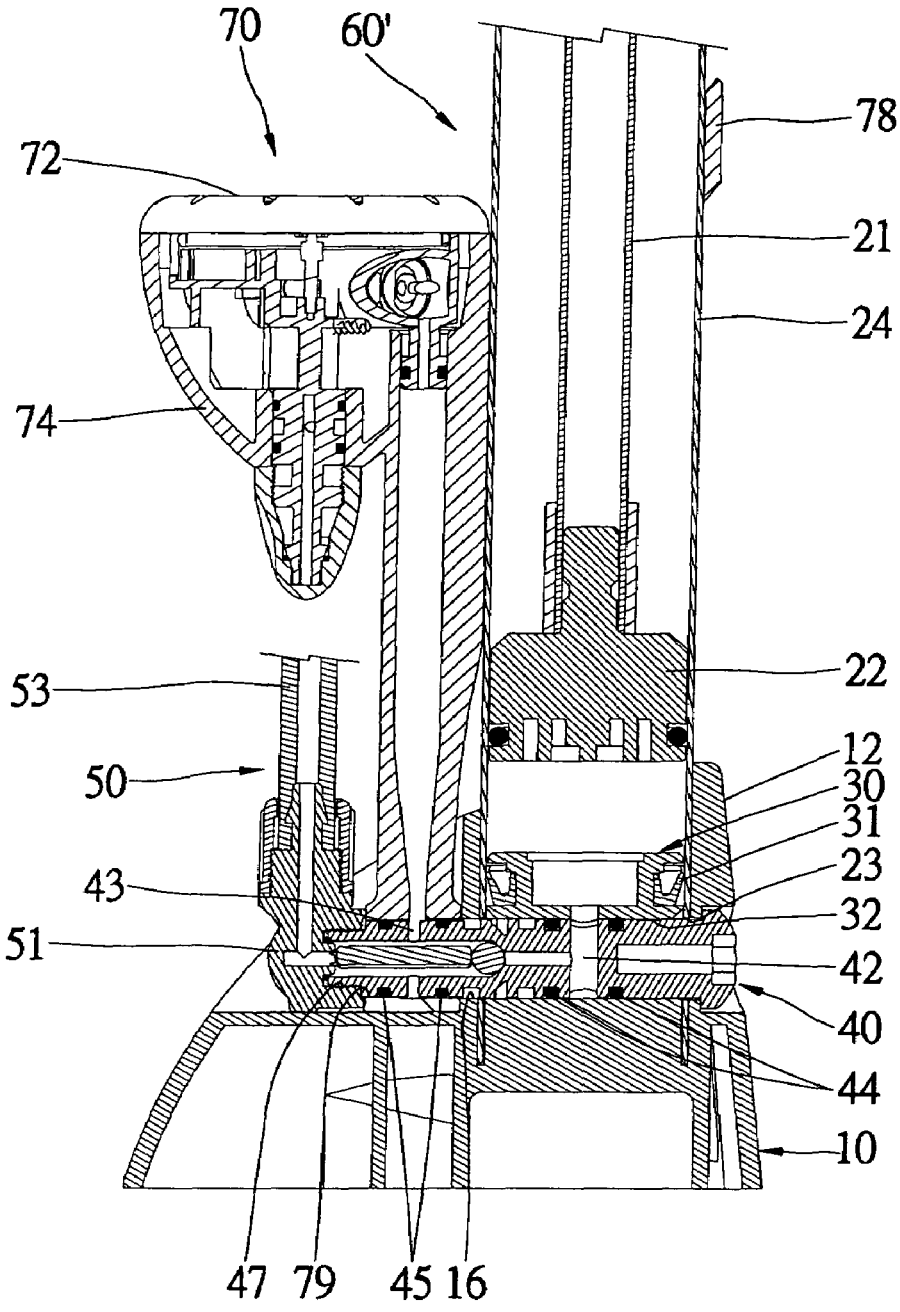
FIG. 4 is a cross-sectional view of a pump according to a second embodiment of the present invention.

FIG. 4 shows a pump 60' according to a second embodiment of the present invention. The pump 60' is identical to the pump 60 except that first joint 30 is integrated with the base 10. The socket 12 can be saved in the pump 60'.

The present invention has been described via detailed illustration of two embodiments. Those skilled in the art can derive variations from the embodiments without departing from the scope of the present invention. Hence, the embodiments shall not limit the scope of the present invention. The scope of the present invention is defined in the claims.

The invention claimed is:

1. A pump comprising:

a base comprising a socket, wherein the socket defines two apertures;

a pumping set comprising a cylinder inserted in the socket and a piston put in the cylinder, wherein the cylinder defines two apertures;

a first joint put in the cylinder, the first joint comprising a transverse channel and an axial channel in communication with the transverse channel;

a gauge set comprising a gauge, a housing for receiving the gauge and a tube extending from the housing, wherein the tube defines two apertures;

a second joint inserted in the two apertures of the socket, the two apertures of the cylinder, the first joint and the two apertures of the tube, the second joint comprising an axial channel, a first transverse channel for communicating the axial channel thereof with the axial channel of the first joint and a second transverse channel for communicating the axial channel thereof with the tube; and a nozzle set connected to the second joint, with the tube located intermediate the socket and the nozzle set, with the nozzle set including a nozzle in communication with the second joint, with the second joint being in communication with the axial channel of the first joint, with the second joint being in direct communication with the tube of the gauge set and in direct communication with the nozzle set independent of the communication with the tube of the gauge set.

2. The pump according to claim 1 wherein the gauge set comprises a collar formed on the tube, and the cylinder is inserted in the socket through the collar.

3. The pump according to claim 1 wherein the gauge set further comprises a collar formed on the tube, with the housing, tube and collar integrally formed as a single, inseparable component of a same material, with the cylinder slideably received in the collar parallel to the tube.

4. The pump according to claim 3 wherein the pumping set comprises a rod connected with the piston.

5. The pump according to claim 4 wherein the pumping set comprises a handle attached to the rod.

6. The pump according to claim 3 wherein the base comprises at least one pedal extending from the socket.

7. The pump according to claim 3 wherein the nozzle receives a valve of an article to be pumped, and wherein the nozzle set further includes a pipe for communicating the nozzle with the second joint.

8. The pump according to claim 7 wherein the nozzle set comprises a cap connected to the second joint and for communicating the pipe with the second joint.

9. The pump according to claim 3 wherein the second joint includes a head for abutment against the cylinder, with the cylinder and the tube sandwiched between the nozzle set and the head.

10. The pump according to claim 3 wherein the first joint is made independent of the base.

11. The pump according to claim 3 wherein the first joint is integrated with the base.

12. A pump comprising:

a base comprising a socket, wherein the socket defines two apertures;

a first joint formed thereon put in the cylinder, the first joint comprising a transverse channel and an axial channel in communication with the transverse channel;

a pumping set comprising a cylinder for receiving the first joint and a piston put in the cylinder, the cylinder defining two apertures in communication with the transverse channel of the first joint;

a gauge set comprising a gauge, a housing for receiving the gauge and a tube extending from the housing and defining two apertures in communication with the transverse channel of the first joint;

a second joint inserted in the apertures of the cylinder, the transverse channel of the first joint and the apertures of the tube, the second joint comprising an axial channel, a first transverse channel for communicating the axial channel thereof with the axial channel of the first joint and a second transverse channel for communicating the axial channel thereof with the tube;

a cap connected to the second joint, with the tube located intermediate the socket and the cap, with the cap being in communication with the second transverse channel; and a nozzle in communication with the second joint through the cap, with the second joint being in direct communication with the tube of the gauge set via the second transverse channel and the axial channel, with the second joint being in direct communication with the nozzle set via the axial channel and the cap and independent of communication with the tube of the gauge set.

13. The pump according to claim 12 wherein the gauge set comprises a collar formed on the tube, and the cylinder is inserted in the socket through the collar.

14. The pump according to claim 12 wherein the gauge set further comprises a collar formed on the tube, with the housing, tube and collar integrally formed as a single, inseparable component of a same material, with the cylinder slideably received in the collar parallel to the tube.

15. The pump according to claim 14 wherein the second joint includes a head for abutment against the cylinder, with the cylinder and the tube sandwiched between the nozzle set and the head.

* * * * *